US010632590B2

(12) United States Patent
Tsukada et al.

(10) Patent No.: US 10,632,590 B2
(45) Date of Patent: Apr. 28, 2020

(54) WORK PROCESSING APPARATUS AND LIQUID CHEMICAL BAG FOR THE SAME

(71) Applicants: Fujikoshi Machinery Corp., Nagano (JP); National Institute of Advanced Industrial Science and Technology, Tokyo (JP)

(72) Inventors: Masayuki Tsukada, Nagano (JP); Kazutaka Shibuya, Nagano (JP); Takayuki Fuse, Nagano (JP); Yoshio Nakamura, Nagano (JP); Shiro Hara, Ibaraki (JP)

(73) Assignees: FUJIKOSHI MACHINERY CORP., Nagano (JP); NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 524 days.

(21) Appl. No.: 15/370,670

(22) Filed: Dec. 6, 2016

(65) Prior Publication Data

US 2017/0157735 A1 Jun. 8, 2017

(30) Foreign Application Priority Data

Dec. 8, 2015 (JP) ..... 2015-239060

(51) Int. Cl.
*B24B 37/24* (2012.01)
*B24B 37/34* (2012.01)
*B24B 37/20* (2012.01)

(52) U.S. Cl.
CPC ..... *B24B 37/34* (2013.01); *B24B 37/20* (2013.01)

(58) Field of Classification Search
CPC ..... B24B 55/00; B24B 57/00; B24B 57/02; B24B 37/34; B24B 37/20; H01L 21/306;
(Continued)

(56) References Cited

U.S. PATENT DOCUMENTS 4,669,124 A * 5/1987 Kimura ..... B65D 41/34 206/807
6,358,125 B2 * 3/2002 Kawashima ..... B01F 3/088 210/416.1

(Continued)

FOREIGN PATENT DOCUMENTS

JP H05016969 1/1993
JP H11138439 5/1999

(Continued)

OTHER PUBLICATIONS

Office Action dated Jul. 16, 2019 in corresponding Japanese Application No. 2015-239060.

*Primary Examiner* — Robert A Rose
(74) *Attorney, Agent, or Firm* — Stephen J. Weyer, Esq.; Stites & Harbison, PLLC

(57) ABSTRACT

The work processing apparatus of the present invention comprises: a processing section for processing or treating a work; and a liquid chemical supplying section for supplying a liquid chemical to the processing section. The liquid chemical supplying section includes: a plurality of liquid chemical bags for storing the liquid chemical; a bag holding part in which the liquid chemical bags are attached and held; and a liquid feeding part, to which the liquid chemical bags are detachably connected, for feeding the liquid chemical from the liquid chemical bags to the processing section. Each of the liquid chemical bags is produced by overlapping flexible resin sheets with each other and welding their edge parts to form into a bag. Each of the liquid chemical bags has a port part communicating with an outside. A joint with a valve is attached to each of the port parts.

15 Claims, 12 Drawing Sheets

(58) Field of Classification Search
CPC ..... H01L 21/67; H01L 21/67092; H01L 21/30625
USPC ..... 451/41, 287–290, 60, 446
See application file for complete search history.

(56) References Cited

U.S. PATENT DOCUMENTS

| | | | | |
|---|---|---|---|---|
| 8,507,382 | B2 * | 8/2013 | Hughes | B24B 57/02 137/263 |
| 2014/0154958 | A1 | 6/2014 | Nakamura et al. | |

FOREIGN PATENT DOCUMENTS

| | | |
|---|---|---|
| JP | 2005052952 | 3/2005 |
| JP | 2007245490 | 9/2007 |
| JP | 2012511367 | 5/2012 |

* cited by examiner

WORK PROCESSING APPARATUS AND LIQUID CHEMICAL BAG FOR THE SAME

CROSS-REFERENCE TO RELATED APPLICATION

This application is based upon and claims the benefit of priority of the prior Japanese Patent Application No. 2015-239060, filed on Dec. 8, 2015, and the entire contents of which are incorporated herein by reference.

FIELD

The present invention relates to a work processing apparatus and a liquid chemical bag for the work processing apparatus.

BACKGROUND

A semiconductor wafer polishing apparatus has been known as an example of a work processing apparatus. In the semiconductor wafer polishing apparatus, a surface of a wafer is polished by steps of: bringing the surface of the wafer held by a wafer holding plate (e.g., a carrier) of a polishing head; and relatively moving a polishing plate and the polishing head, with respect to each other, with supplying a polishing liquid from a polishing liquid feeding unit to a polishing cloth adhered on an upper face of the polishing plate.

An example of a conventional polishing liquid feeding unit (i.e., a slurry feeding unit) of the semiconductor wafer polishing apparatus is disclosed in Patent Document 1.

In a process of polishing a semiconductor wafer, a polishing liquid (i.e., slurry) is dried on surfaces of liquid paths of the polishing apparatus through which slurry and pure water flow, a wafer processing section thereof, the wafer to be polished, etc., so the dried solid slurry causes following serious problems: lowering polishing performance; lowering flatness of the surface of the wafer; and making flows of liquids in the apparatus and liquid tanks worse. To avoid the problems, a method of automatically replenishing a slurry, in which the slurry in a slurry tank is automatically suitably replenished so as to prevent the slurry tank from being dried, prevent a liquid surface of the slurry from being lowered and prevent the slurry from being solidified, has been known.

For example, the slurry feeding unit disclosed in Patent Document 1 has a liquid surface sensor or a load cell for detecting a residual quantity of the slurry in the slurry tank so as to automatically replenish the slurry and automatically stop replenishing the slurry. Further, the slurry is replenished in accordance with the replenishing sequence, by using a timer, before the slurry is dried on an inner wall surface of the slurry tank, and the inside of the tank is humidified by using a spray nozzle or a humidification unit at an arbitrary time interval.

PRIOR ART DOCUMENT

Patent Document 1: Japanese Laid-open Patent Publication No. 2005-52952

SUMMARY

In the slurry feeding unit disclosed in Patent Document 1, drying, condensing and depositing the slurry in the slurry tank can be prevented, so that diameters of polishing particles and a concentration thereof in the slurry can be equalized. However, in the slurry feeding unit disclosed in Patent Document 1, a unit of automatically replenishing the slurry including the liquid surface sensor, the humidification unit and the spray nozzle must be required, so a control program must be complex and the polishing apparatus must be large.

By the way, the applicant of the present invention has developed a multifunctional polishing apparatus on the basis of a minimal fab concept. In the multifunctional polishing apparatus, a primary polishing (rough polishing) of a small size semiconductor wafer whose diameter is about ½ inch, a secondary polishing (finish polishing) thereof, cleaning the polishing head and cleaning the semiconductor wafer can be performed in one polishing apparatus (see Japanese Laid-open Patent Publication No. 2014-132642). In such polishing apparatus, a first polishing liquid, a second polishing liquid, a cleaning liquid and a rinsing liquid (a protection liquid for preventing the slurry from being dried and adhered on the surface of the semiconductor wafer) are used as liquid chemicals, so a plurality of liquid chemicals feeding units are required. However, it is spatially difficult to arrange large feeding units, which are respectively required for the liquid chemicals and which are like the large slurry feeding unit disclosed in Patent Document 1, around one polishing apparatus.

The present invention has been invented to solve the above described problems. An object of the present invention is to provide a work processing apparatus which is capable of preventing liquid chemicals from being dried, condensed and deposited and which can realize a small apparatus capable of using a plurality of liquid chemicals, and another object is to provide a liquid chemical bag which is used in the work processing apparatus and capable of highly preventing air from invading into the liquid chemical bag.

Liquid chemical bags are used, as drip bags, in a medical field. The drip bags are not made of hard resin materials. In case that the drip bag is made of a hard resin material, when a liquid in the drip bag is reduced, air whose volume is equal to that of the liquid reduced must be supplied into the drip bag. If no air is supplied, negative pressure is produced in the drip bag and the liquid cannot be sent. In case of the liquid chemical bag made of a soft resin material, when a liquid chemical in the liquid chemical bag is reduced, the liquid chemical bag is deflated and no air enters the liquid chemical bag. However, in case of the drip bag, the drip bag must be suspended at a position higher than a dripping position of a patient so as to send the liquid by using gravity. This limitation causes some problems in an industrial field. The liquid chemical bag must be set at a position higher than a use position. Further, when the liquid chemical is reduced, a weight of the liquid chemical is reduced and a force for sending the liquid chemical is also reduced, so a flow quantity of the liquid chemical is reduced. Thus, in the industrial field, a pump is usually used. However, even if the pump is used, invasion of air into the liquid chemical bag must be prevented. Methods and means for solving the above described problem have not been found. The present invention provides a mechanism for controlling the invasion of air into the liquid chemical bag.

To achieve the objects, the present invention has following structures.

Namely, the work processing apparatus of the present invention comprises:

a processing section for processing or treating a work; and a liquid chemical supplying section for supplying a liquid chemical to the processing section, the liquid chemical supplying section includes: a plurality of liquid chemical bags for storing the liquid chemical; a bag holding part in which the liquid chemical bags are attached and held; and a liquid feeding part, to which the liquid chemical bags are detachably connected, for feeding the liquid chemical from the liquid chemical bags to the processing section, each of the liquid chemical bags is produced by overlapping flexible resin sheets with each other and welding their edge parts to form into a bag, and has a port part communicating with an outside, and a joint with a valve is attached to each of the port parts.

A filling device, which can prevent contamination of air into the liquid chemical bags when filling the liquid chemical bags with the liquid chemical, may be provided to the work processing apparatus. The filling device may be provided in the work processing apparatus or may be separately provided an outside of the work processing apparatus. Note that, besides the work processing apparatus, the filling device for filling the liquid chemical bag with the liquid chemical may become an independent invention.

For example, the filling device may include:

a raw liquid storing part for storing a raw liquid of the liquid chemical;

a pure water storing part for storing pure water;

a mounting part on which the liquid chemical bag is mounted;

a discharge tank;

a first pipeline being communicated with the liquid chemical bags, from the raw liquid storing part, via a first check valve, a first three-way valve and a second three-way valve in this order, the first pipeline being capable of supplying the liquid chemical from the raw liquid storing part to the liquid chemical bags;

a second pipeline being communicated with the liquid chemical bags, from the pure water storing part, via a second check valve, the first three-way valve and the second three-way valve in this order, the second pipeline being capable of supplying the pure water from the pure water storing part to the liquid chemical bags;

a third pipeline being communicated with the discharge tank, from the liquid chemical bags, via the second three-way valve and a third check valve in this order, the third pipeline being capable of discharging air from the liquid chemical bags to the discharge tank;

a first pump being provided to the first pipeline between the first check valve and the raw liquid storing part, the first pump feeding the liquid chemical from the raw liquid storing part to the liquid chemical bags via the first pipeline;

a second pump being provided to the second pipeline between the second check valve and the pure water storing part, the second pump feeding the pure water from the pure water storing part to the liquid chemical bags via the second pipeline; and a third pump being provided to the third pipeline between the third check valve and the discharge tank, the third pump discharging air from the liquid chemical bags to the discharge tank via the third pipeline.

The liquid chemical bag of the present invention, which stores a liquid chemical to be supplied to a processing section of a work processing apparatus, is produced by overlapping flexible resin sheets with each other and welding their edge parts to form into a bag, and the liquid chemical bag has a port part, which communicates with an outside and to which a joint with a valve is attached, and an engage part for suspending and holding the liquid chemical bag, in a bag holding part of the work processing apparatus, in a state where the joint with the valve is on the upper side.

By the present invention, drying, condensing and depositing the liquid chemical can be prevented. The work processing apparatus capable of using a plurality of the liquid chemicals can be small in size. Further, the liquid chemical bag, which can highly prevent invasion of air, can be provided.

BRIEF DESCRIPTION OF THE DRAWINGS

Embodiments of the present invention will now be described by way of examples and with reference to the accompanying drawings which are given by way of illustration only, and thus are not limitative of the present invention, and in which.

DESCRIPTION OF THE EMBODIMENTS

Preferred embodiments of the present invention will now be described in detail with reference to the accompanying drawings.

Figure 1:
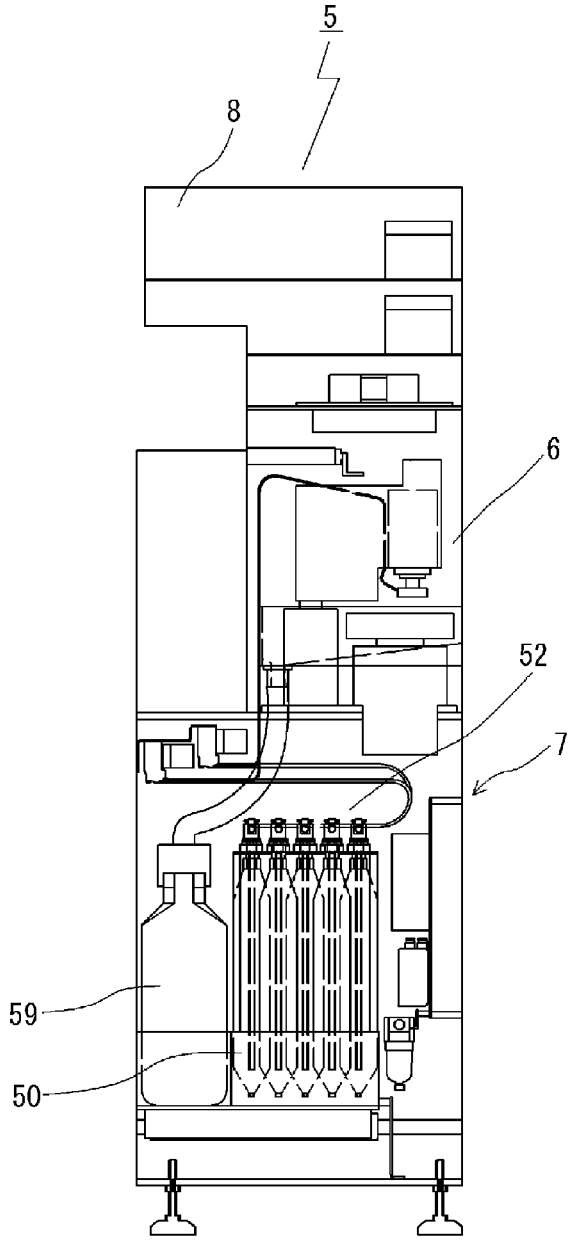
FIG. 1 is a side view of a polishing apparatus.
Figure 2:
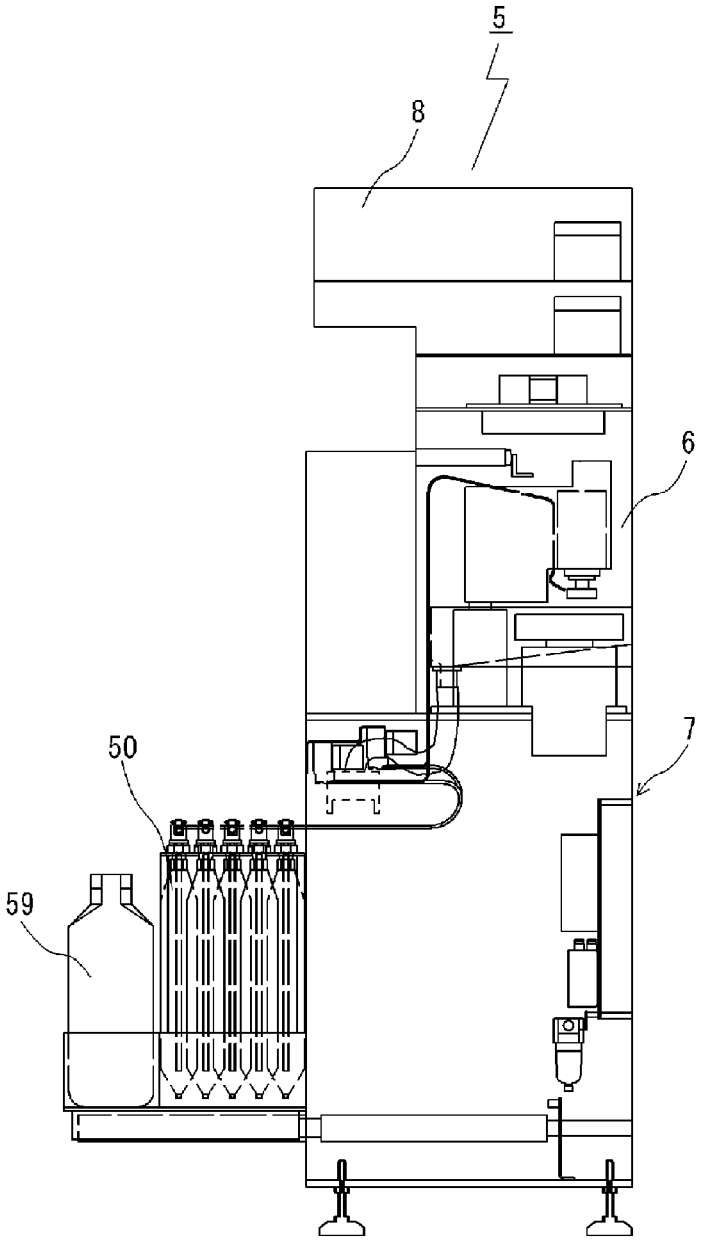
FIG. 2 is a side view of the polishing apparatus in which a bag holding part is drawn out.
Figure 3:
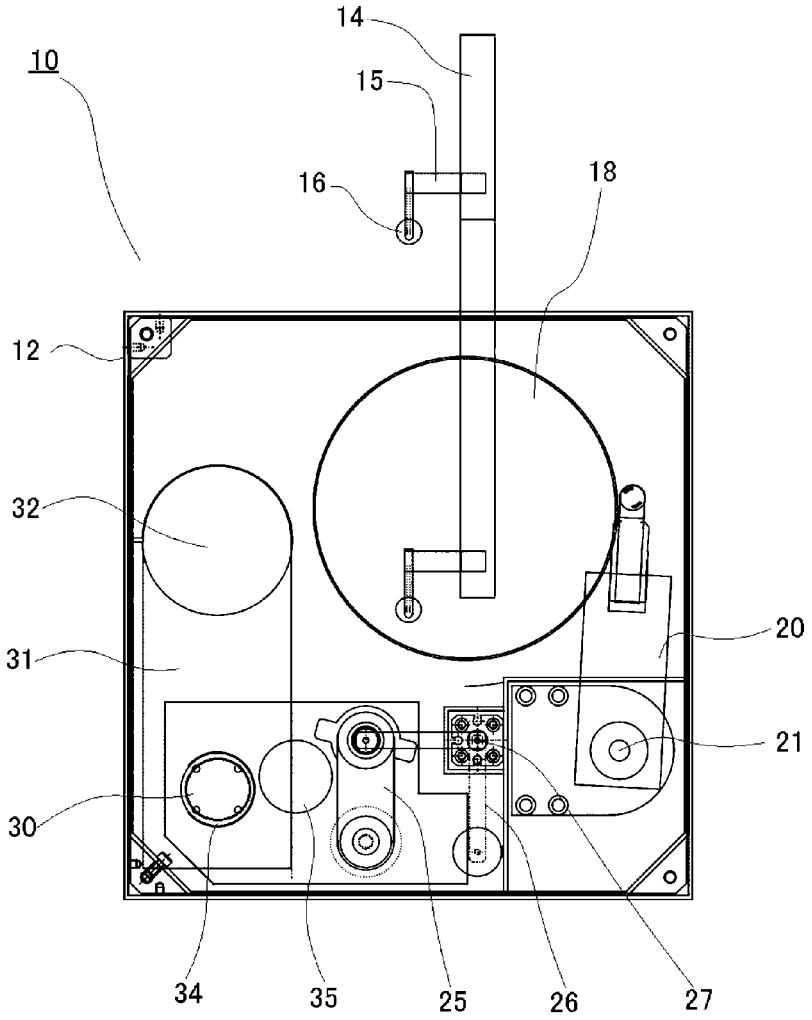
FIG. 3 is an explanation view of a polishing section.
Figure 4:
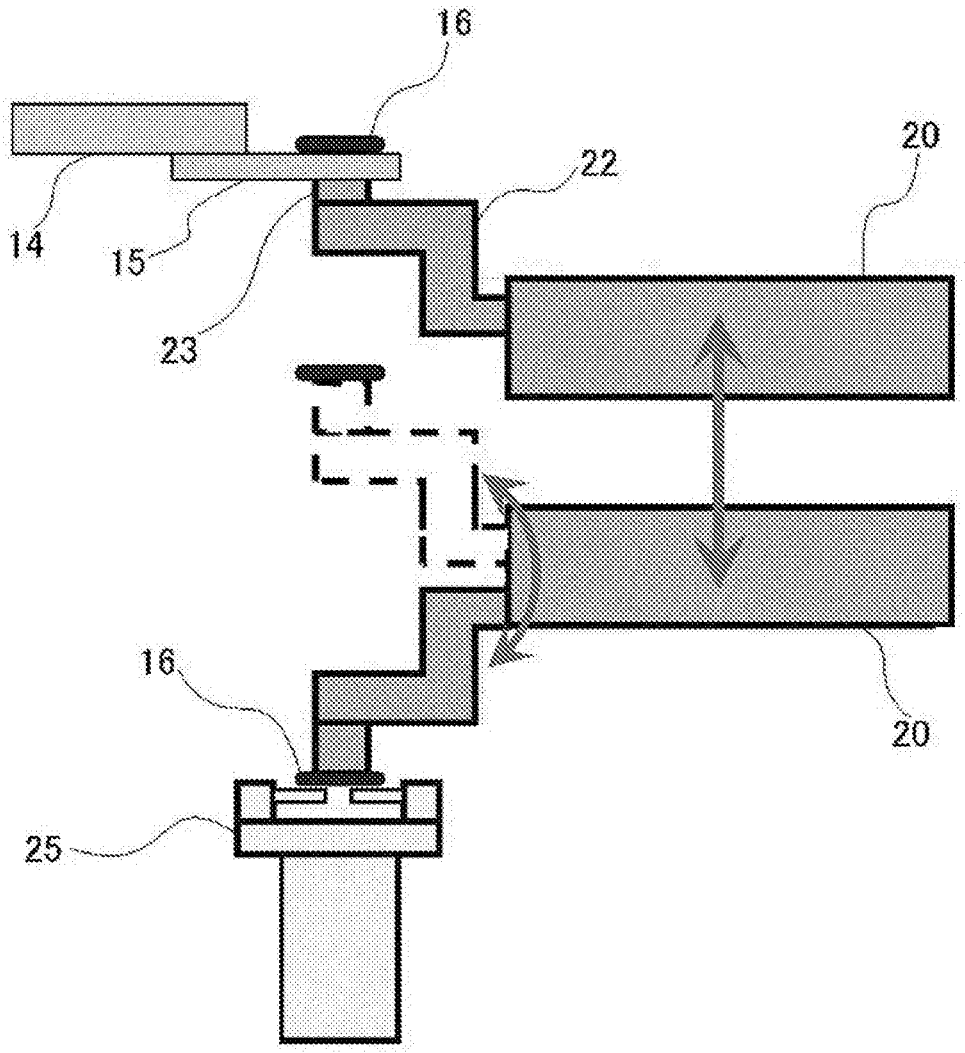
FIG. 4 is an explanation view of a working state of a transferring arm.
Figure 5:
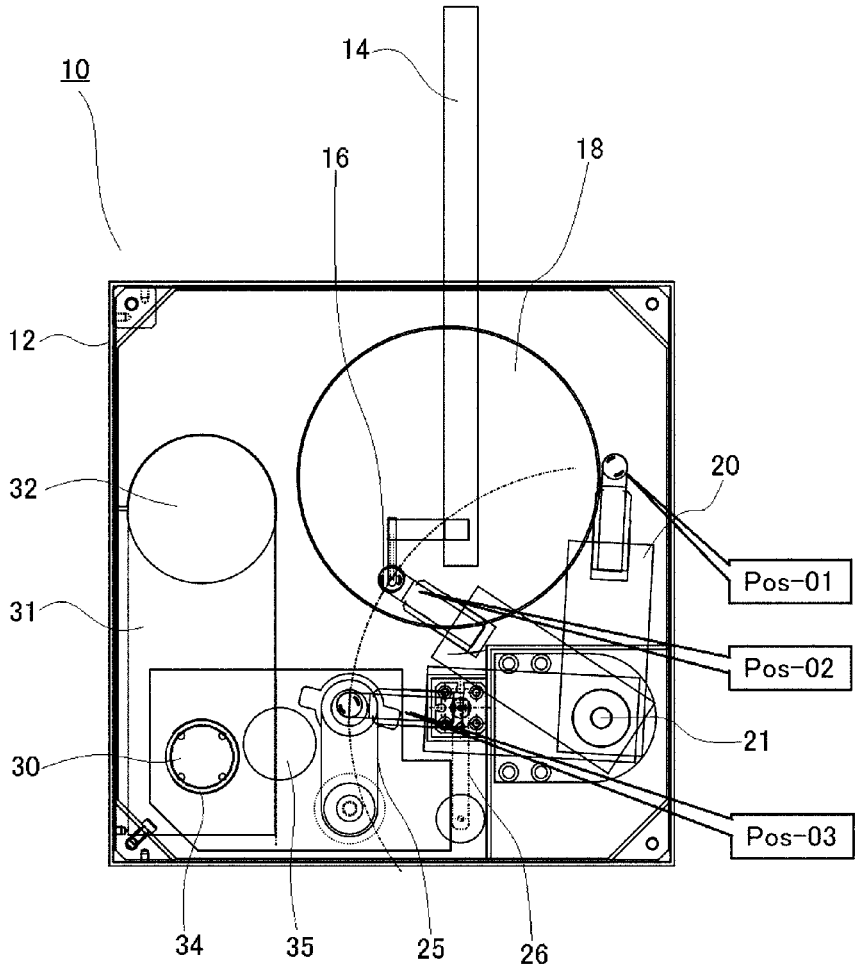
FIG. 5 is an explanation view of a position of the transferring arm turned.
Figure 6:
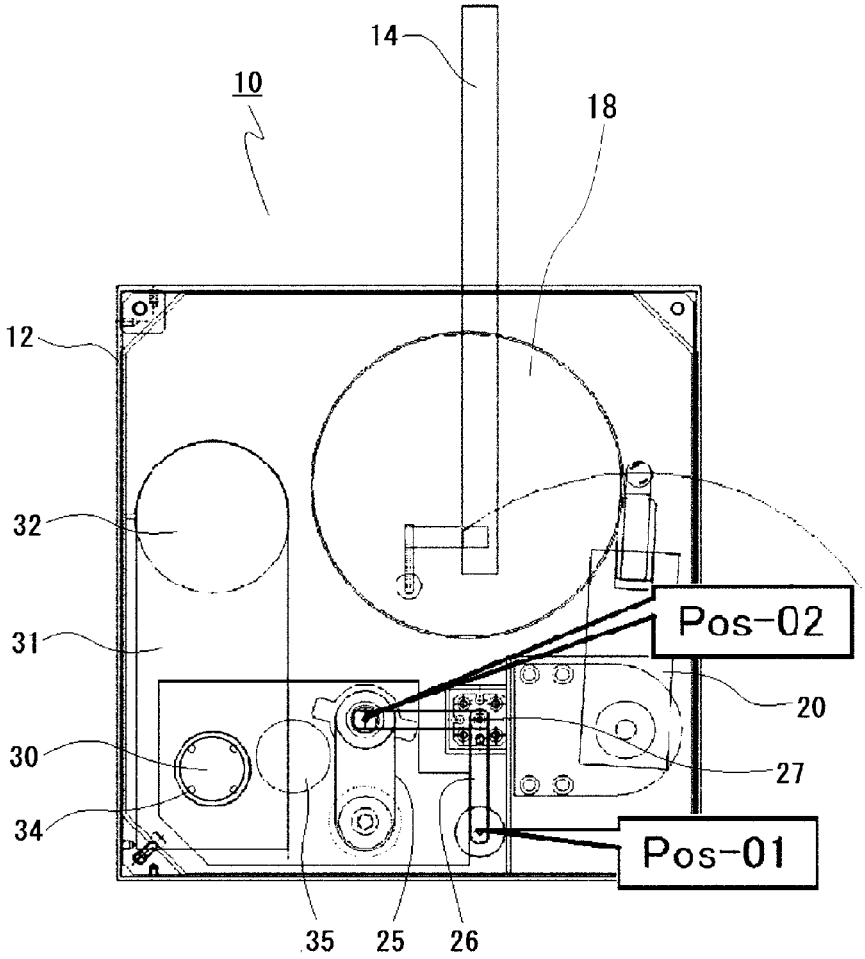
FIG. 6 is an explanation view of a position of a stopper turned.
Figure 7:
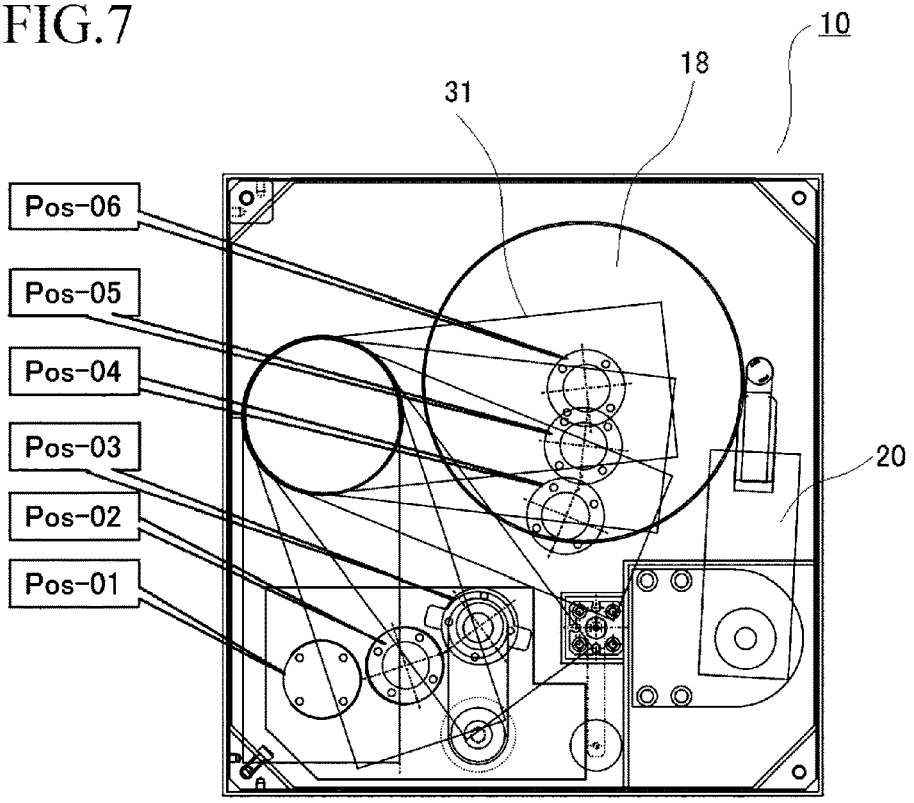
FIG. 7 is an explanation view of a position of an arm unit turned.
Figure 8:
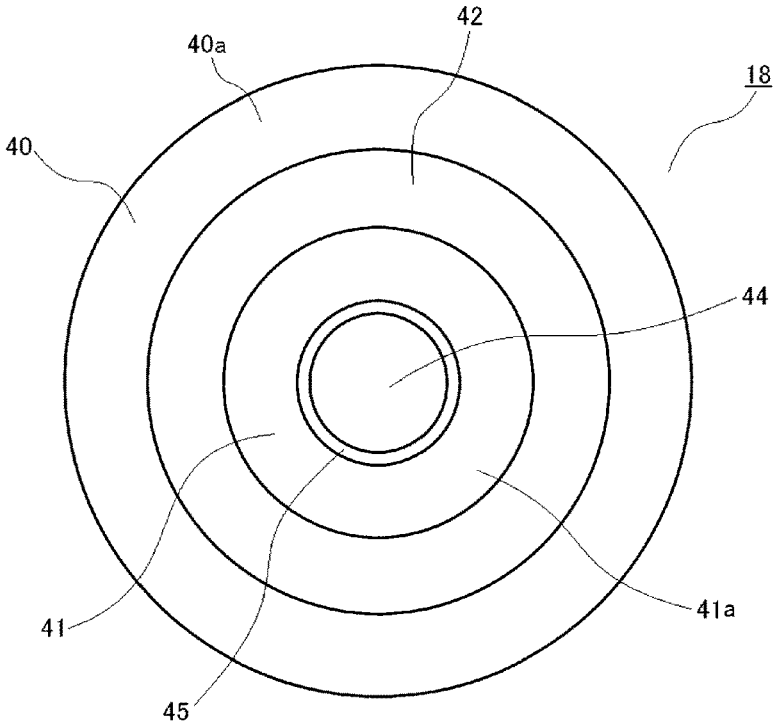
FIG. 8 is a schematic plan view of a polishing plate.

A polishing apparatus 5, which is an example of the work processing apparatus of the present invention, will be explained. FIG. 1 is a side view of the polishing apparatus 5 in which a side cover is detached, and FIG. 2 is a side view of the polishing apparatus 5 in which a bag holding part is forwardly drawn out and the side cover is detached. FIG. 3 is an explanation view of a polishing section, FIG. 4 is an explanation view of a working state of a transferring arm, FIG. 5 is an explanation view of a position of the transferring arm turned, FIG. 6 is an explanation view of a position of a stopper turned, and FIG. 7 is an explanation view of a position of an arm unit turned. FIG. 8 is a schematic plan view of a polishing plate.

The polishing apparatus 5 shown in FIG. 1 is an example of the polishing apparatus which is based on the minimal fab concept and which relates to a polishing apparatus of a prior patent application filed by the applicant of the present invention (see Japanese Laid-open Patent Publication No. 2014-132642). As described above, the polishing apparatus is used for polishing the small size semiconductor wafer whose diameter is about ½ inch (see Japanese Laid-open Patent Publication No. 2014-132642).

As shown in FIGS. 1 and 2, a center part of the polishing apparatus 5 is a polishing section (i.e., a processing section) 6, and a lower part thereof is a liquid chemical supplying section 7. A control section 8 for controlling each section is provided to an upper part of the polishing apparatus 5.

Firstly, the polishing section 6 will be explained.

In FIG. 3, structural elements of the polishing apparatus 5 are provided in a processing chamber 12. The size of the processing chamber 12 is standardized on the basis of the minimal fab concept, and the size is about 30 cm square. Therefore, the structural elements of the polishing apparatus 5 are downsized so as to be arranged in the processing chamber 12 of such size.

In FIG. 3, a conveying arm 14 has a mounting part 15, which is formed into, for example, a U-shape. A wafer 16 to be polished is mounted on the mounting part 15 like a bridge in a state where a surface to be polished is turned upward, and the wafer 16 is conveyed from an outside of the processing chamber 12 to an approximate center part thereof. Note that, the conveying arm 14 conveys the wafer 16, which has been polished, cleaned and dried, to the outside of the processing chamber 12. A driving mechanism (not shown) of the conveying arm 14 is not limited. For example, a rack and pinion mechanism, a cylinder mechanism, etc. may be employed.

A polishing plate 18, which can be rotated in a horizontal plane, is provided in the processing chamber 12 and under the conveying arm 14. As shown in FIG. 8, the polishing plate 18 comprises: a primary polishing plate 40 and a secondary polishing plate 41, which are concentrically disposed and have a prescribed width capable of polishing the wafer and on which polishing cloths 40*a* and 41*a* are adhered; a groove 42 being formed between the primary polishing plate 40 and the secondary polishing plate 41 so as to discharge a used polishing liquid; and a cleaning part 44, which is provided at a center part of the polishing plate 18 on an inner side of the secondary polishing plate 41 and which cleans a polishing head 30. Further, a groove 45 for discharging the used polishing liquid is formed between the secondary polishing plate 41 and the cleaning part 44.

As shown in FIG. 3, a transferring arm 20, which is used for transferring the wafer 16, is provided at a side of the polishing plate 18.

The transferring arm 20 is capable of turning, about a shaft 21, in a horizontal plane and between a position Pos01 (i.e., a standby position) and a position Pos03 (see FIG. 5). A reversing arm 22, which can be turned upward and downward, is provided to a front end part of the transferring arm 20. A wafer sucking section 23 is provided to a front end part of the reversing arm 22. The wafer sucking section 23 is capable of sucking and holding the wafer 16, receiving the wafer 16 from the mounting part 15 and transferring the wafer 16 to the mounting part 15. Each of parts of the transferring arm 20 can be actuated by a suitable motor (not shown), etc. (see FIGS. 4 and 5)

A cleaning/drying unit 25, which acts as a mounting port on which the wafer 16 will be mounted and which cleans and dries the wafer 16, is provided at a side of the polishing plate 18. The transferring arm 20 sucks and holds the wafer 16 to receive the wafer 16 from the mounting part 15 of the conveying arm 14 (at the position Pos02), inverts the wafer 16, conveys the wafer 16 to the mounting port of the cleaning/drying unit 25 (at the position Pos03) and transfers the wafer 16, which has been cleaned and dried, from the mounting port of the cleaning/drying unit 25 (at the position Pos03) to the mounting part 15 of the conveying arm 14 (at the position Pos02).

A stopper 26 (a press arm) is provided at a side of the polishing plate 18 and can be turned, about a shaft 27, between the position Pos01 and the position Pos02 as shown in FIG. 6. When the wafer 16 is conveyed to the cleaning/drying unit 25 for cleaning, the stopper 26 is turned to a position above the wafer 16 (the position Pos02), so that the wafer 16 is never blown off by a pressure of a cleaning liquid.

An arm unit 31 for driving the polishing head 30 is provided at a side of the polishing plate 18. The polishing head 30 is held by the arm unit 31. The arm unit 31 is capable of turning, about a shaft 32, between a position Pos01 and a position Pos06 shown in FIG. 7.

A mounting part 34, on which a ring-shaped grindstone (not shown) acting as a dressing member will be mounted, is provided at a position under the polishing head 30 located at the position Pos01. Further, a mounting part 35, on which a brush (not shown) acting as a dressing member will be mounted, is provided adjacent to the mounting part 34.

The wafer 16 and the dressing members are detachably attached to the polishing head 30, and the polishing head 30 can be moved to the position of the mounting part 34 (the position Pos01), the position of the mounting part 35 (the position Pos02), the position of the cleaning/drying unit 25 (the position Pos03), the position of the primary polishing plate 40 of the polishing plate 18 (the position Pos04), the position of the secondary polishing plate 41 of the polishing plate 18 (the position Pos05) and the position of the cleaning part 44 of the polishing plate 18 (the position Pos06) by turning the arm unit 31, so that the primary polishing step, the secondary polishing step and the cleaning step can be continuously performed (see FIG. 7). Therefore, the multi-functional polishing apparatus can be realized.

The polishing head 30 is provided to the arm unit 31, which can be turned about the shaft 32, and the position Pos01 of the mounting part 34, the position Pos02 of the mounting part 35, the position Pos03 of the cleaning/drying unit 25, the position Pos04 of the primary polishing plate 40 of the polishing plate 18, the position Pos05 of the secondary polishing plate 41 thereof and the position Pos06 of the cleaning part 44 are disposed on the same circular line. With this structure, a spatial structure of the wafer polishing apparatus 5 can be compacted.

The steps of cleaning and dry the wafer 16 will be explained.

The sequential cleaning and drying steps are controlled by the control section 8 on the basis of prescribed programs.

Firstly, the wafer 16 is mounted onto the mounting part 15 of the conveying arm 14 in a state where the surface of the wafer to be polished faces upward.

Next, the wafer 16 is conveyed from the outside of the processing chamber 12 to the inside thereof by the conveying arm 14.

Next, the transferring arm 20 receives the wafer 16 from the conveying arm 14, inverts the wafer 16 and mounts the wafer 16 onto the mounting port of the cleaning/drying unit 25 in a state where the surface of the wafer to be polished faces downward.

Next, the arm unit 31 is turned, and the polishing head 30 is moved downward to suck and hold the wafer 16 by the polishing head 30.

Next, the polishing head 30 is moved upward, and the arm unit 31 is turned, then the wafer 16 is pressed onto the polishing cloth 40*a* of the primary polishing plate 40, by moving the polishing head 30 downward, with a prescribed pressing force. Next, the polishing plate 18 and the polishing head 30 are rotated in prescribed directions with supplying a polishing liquid for primary polishing to the primary polishing plate 40 from a nozzle (not shown) so as to perform the primary polishing (rough polishing) of the wafer 16 for a prescribed time. The polishing liquid used in the primary polishing is mainly flown outward from the primary polishing plate 40 and discharged outside by a centrifugal force generated by rotation of the polishing plate 18. Then, a cleaning liquid (e.g., pure water) and a rinsing liquid (e.g., a protection liquid including a surface active agent for preventing the wafer from being dried) are supplied, instead of the polishing liquid for the primary polishing, in this order so as to simply clean the wafer 16. The used cleaning liquid and the used rinsing liquid are discharged outside, by the centrifugal force, as well as the polishing liquid used in the primary polishing.

After completing the primary polishing, the polishing head 30 is moved upward, and the arm unit 31 is turned, then the polishing head 30 is moved downward until the wafer 16 contacts the polishing cloth 41*a* of the secondary polishing plate 41 located on the inner side of the primary polishing plate 40. Next, as well as the primary polishing, the secondary polishing plate 41 and the polishing head 30 are rotated in prescribed directions with supplying a polishing liquid for secondary polishing to the polishing cloth 41*a* of the secondary polishing plate 41 so as to perform the secondary polishing (finish polishing) of the wafer 16 for a prescribed time. The polishing liquid used in the secondary polishing is flown from the polishing cloth 41*a* of the secondary polishing plate 41 into the groove 42, flown to an outside of the polishing plate 18 and discharged the outside by the centrifugal force generated by rotation of the polishing plate 18. The polishing liquid for the secondary polishing is not mixed with that for the primary polishing. Then, the cleaning liquid and the rinsing liquid are supplied, instead of the polishing liquid for the secondary polishing, in this order so as to simply clean the wafer 16. The used cleaning liquid and the used rinsing liquid are discharged the outside, by the centrifugal force, as well as the polishing liquid used in the secondary polishing.

After completing the secondary polishing, the polishing head 30 is moved upward, and the arm unit 31 is turned, then the wafer 16 is mounted onto the mounting port of the cleaning/drying unit 25 by moving the polishing head 30 downward.

In the cleaning/drying unit 25, the cleaning liquid is sprayed toward the wafer 16 so as to clean the wafer 16, then the wafer 16 is dried. When cleaning the wafer 16, the stopper 26 is turned and moved to a position above the wafer 16 so as to hold the wafer 16 on the mounting port. After cleaning the wafer 16, the stopper 26 is turned and moved to the standby position located at the side of the polishing plate 18 and stays there while drying the wafer 16.

The cleaned and dried wafer 16 is transferred from the mounting port of the cleaning/drying unit 25 to the conveying arm 14, by the transferring arm 20, then the wafer 16 is conveyed to the outside of the processing chamber 12 by the conveying arm 14. By performing the above described steps, the polishing process of the work 16 is completed.

Note that, the polishing head 30 is cleaned while the wafer 16 is cleaned and dried by the cleaning/drying unit 25. Namely, the polishing head 30 is moved upward, and the arm unit 31 is turned, then the polishing head 30 is brought into contact with a brush (not shown) of the cleaning part 44, which is located on the inner side of the secondary polishing plate 41, by moving the polishing head 30 downward. Then, the cleaning part 44 is rotated and the cleaning liquid is sprayed from the nozzle (not shown) toward the polishing head 30 so as to clean the polishing head 30. The used cleaning liquid is discharged the outside through the groove 45.

Dressing the polishing plate 18 is performed after cleaning the polishing head 30. Namely, a ring-shaped grindstone is sucked from the mounting part 34 and moved onto the polishing plate 18 by the polishing head 30, then the primary polishing plate 40 and the secondary polishing plate 41 are dressed by rotating the polishing plate 18. After completing the above described dressing step, the ring-shaped grindstone is returned to the mounting part 34.

Then, a brush is sucked from the mounting part 35 and moved onto the polishing plate 18 by the polishing head 30, then the primary polishing plate 40 and the secondary polishing plate 41 are further dressed (i.e., finish dressing) by rotating the polishing plate 18. After completing the finish dressing step, the brush is returned to the mounting part 35.

After completing the finish dressing step, the polishing head 30 is moved to the cleaning part 44 again so as to clean the polishing head 30. After cleaning the polishing head 30, the polishing head 30 is returned to the standby position Pos01. Thus the series of polishing steps are completed.

As described above, cleaning the polishing head 30 and dressing the primary polishing plate 40 and the secondary polishing plate 41 are performed while cleaning and drying the wafer 16, so that the series of polishing steps can be efficiently performed.

Note that, dressing the polishing plate 18 may be performed each time after polishing the wafer 16 or each time after polishing a prescribed number of wafers 16.

Further, cleaning the polishing head 30 by the cleaning part 44 and cleaning the wafer 16 by the cleaning/drying unit 25 may be performed between the primary polishing and the secondary polishing.

Further, the wafer 16 may be cleaned by the cleaning part 44, and cleaning the polishing head 30 and dressing may be performed at the position of the cleaning/drying unit 25.

Successively, the liquid chemical supplying section 7 will be explained with reference to FIGS. 9-13.

Figure 9:
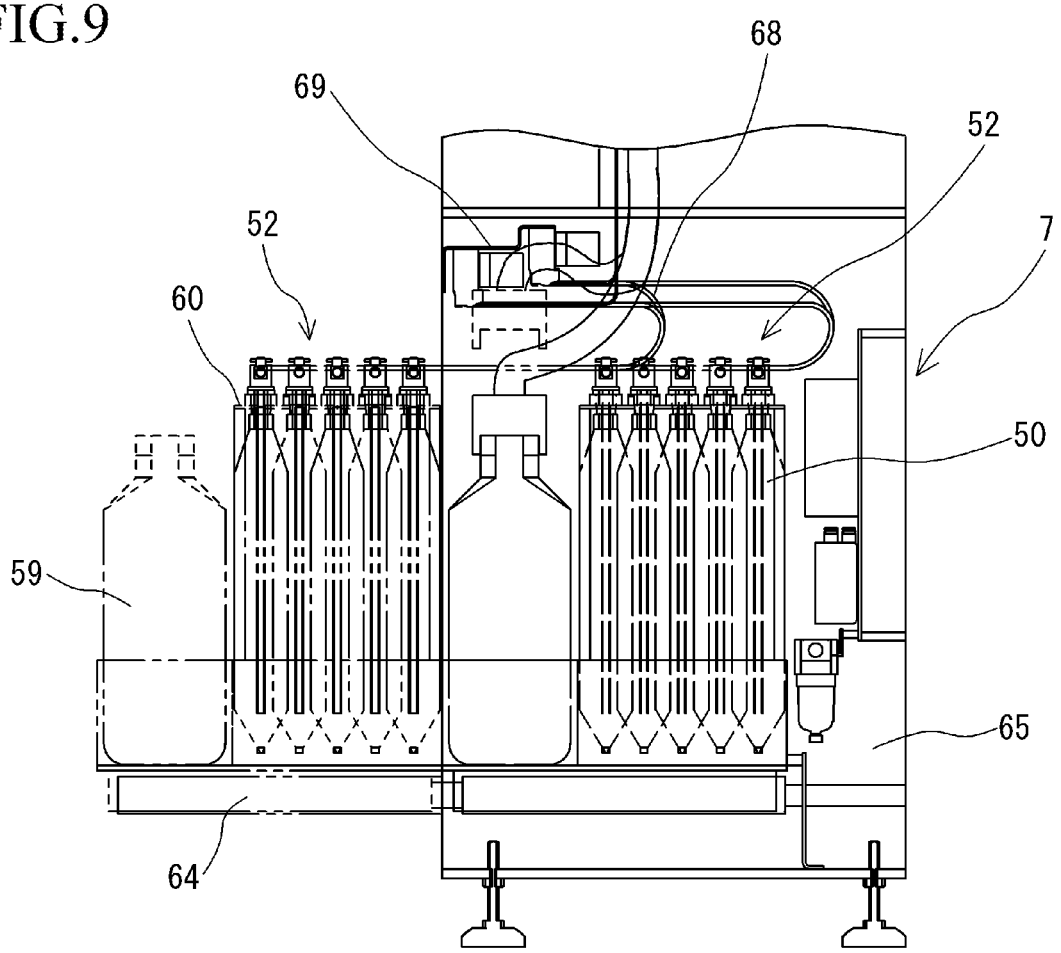
FIG. 9 is an enlarged side view of a liquid chemical supplying section.
Figure 10:
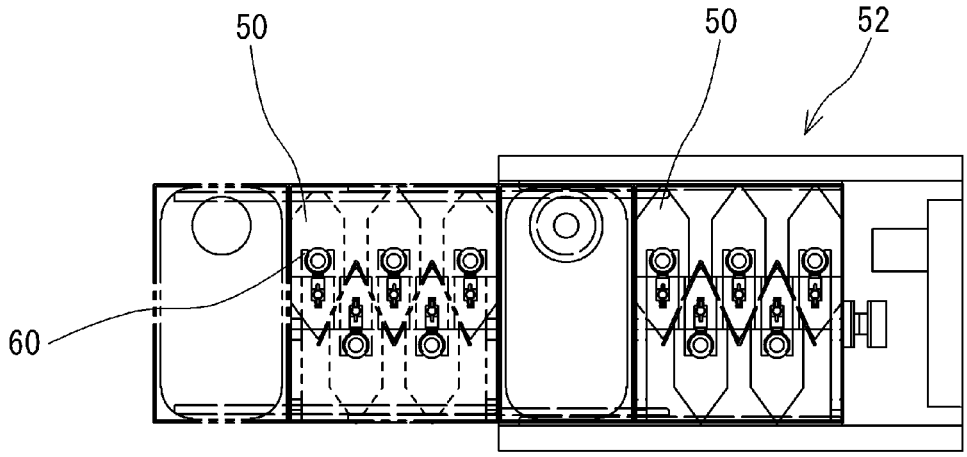
FIG. 10 is a plan view of the liquid chemical supplying section.
Figure 11:
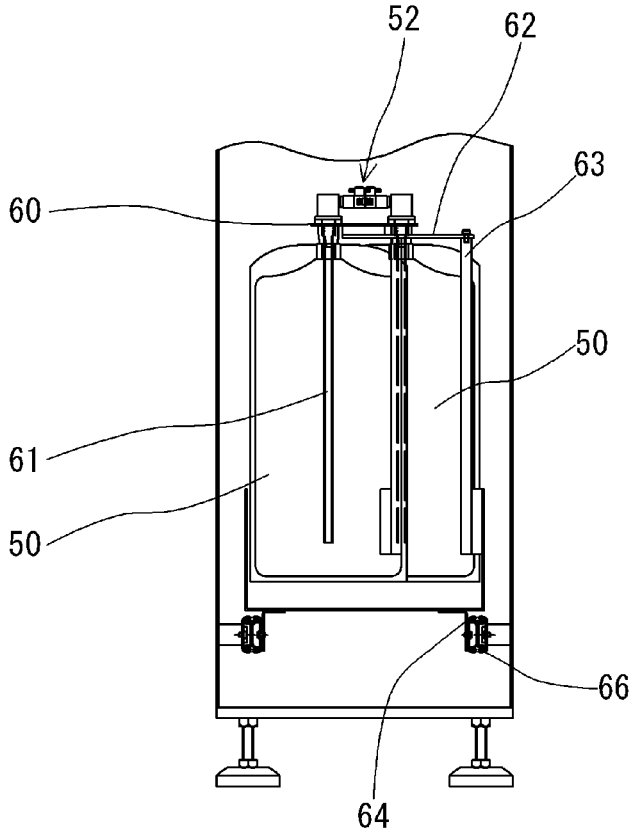
FIG. 11 is a front view of the liquid chemical supplying section.
Figure 12A:
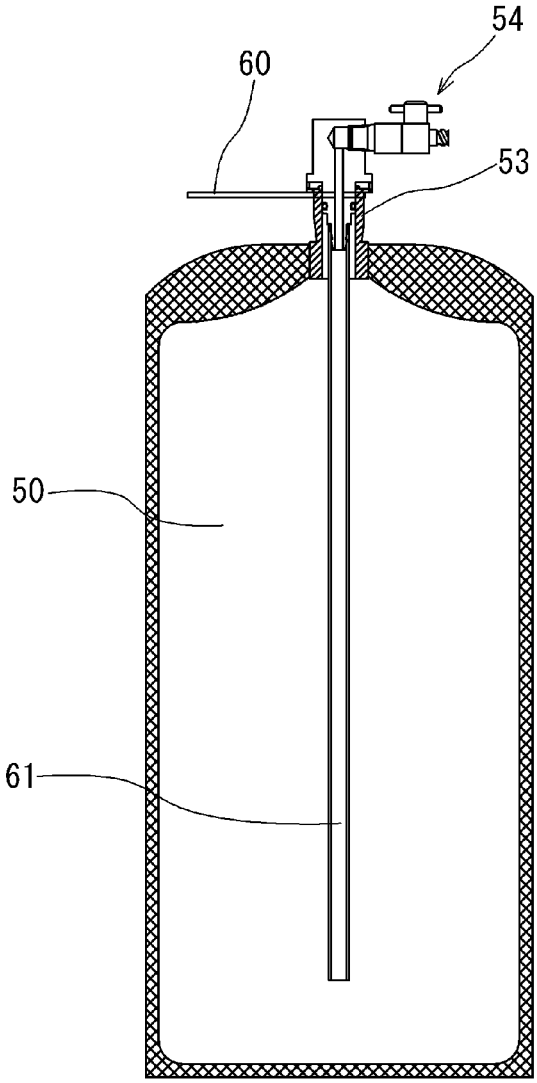
FIG. 12A is a sectional view of a liquid chemical bag.
Figure 12B:
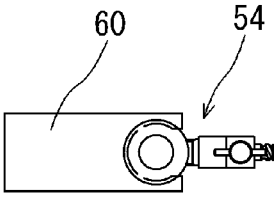
FIG. 12B is a plan view of a suspending tool.
Figure 13:
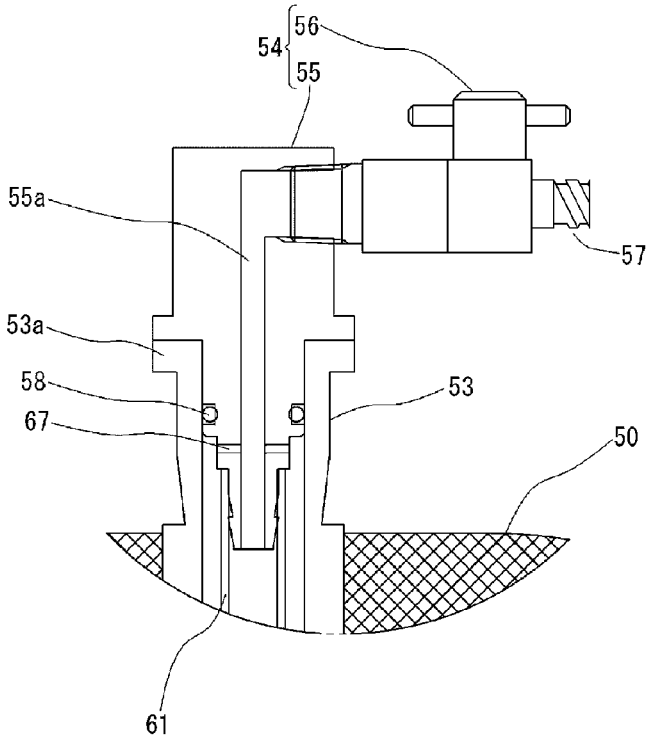
FIG. 13 is a sectional view of a feeding port.

FIG. 9 is an enlarged side view of the liquid chemical supplying section 7, FIG. 10 is a plan view thereof, and FIG. 11 is a front view thereof. FIG. 12A is a sectional view of a liquid chemical bag, FIG. 12B is a plan view of a suspending tool, and FIG. 13 is a sectional view of a feeding port of the liquid chemical bag.

The liquid chemical supplying section 7 is located under the polishing section (the processing section) 6.

In the polishing apparatus 5, the liquid chemical supplying section 7 supplies liquid chemicals, e.g., the polishing liquid for the primary polishing, the polishing liquid for the secondary polishing, the protection liquid (the rinsing liquid) for preventing the surface of the work from being dried, the cleaning liquid (pure water) for cleaning the polishing head 30, to the polishing section 6 so as to variously process the work 16. Note that, in the present embodiment, the liquid chemicals include pure water.

The liquid chemicals are respectively stored in the liquid chemical bags 50, and the liquid chemical bags 50 are suspended from a bag holding part 52 of the liquid chemical supplying section 7.

As shown in FIGS. 12A-13, the liquid chemical bag 50 is made by laminating two flexible resin sheets, whose edge parts are welded to form into a bag, and the liquid chemical bag 50 has a plastic port part 53, which is welded to an end part of the bag and which communicates with an outside. A joint 54 with a valve is attached to the port part 53. Preferably, the flexible resin sheets are composed of transparent resin materials, e.g., PP, PE, PTFE. Each of the flexible resin sheets may be a laminated sheet having a plurality of layers. Preferably, in this case, an inner layer resin sheet has excellent chemical resistance, and an outer layer resin sheet has relatively great strength.

Note that, the liquid chemical bag 50 need not be made by laminating two flexible resin sheets. For example, the liquid chemical bag 50 may be produced by folding one flexible resin sheet twice and welding end parts and edge parts to form into a bag.

The liquid chemical bag 50 is not formed into a bag shape from a cylindrical shape. The liquid chemical bag 50 is formed into the bag shape by laminating the two flexible resin sheets and welding their edge parts. Therefore, when the liquid chemical stored in the liquid chemical bag is reduced, the two flexible resin sheets, which have been separated from each other, deform to the original stable shape at production of the liquid chemical bag, in which the flexible sheets are overlapped each other. Therefore, the liquid chemical bag 50 can be securely deflated without invasion of air into the liquid chemical bag. In case that the liquid chemical bag 50 is produced by folding one flexible resin sheet twice, the liquid chemical bag can be effectively used as far as the folded part does not obstruct the deflation (movement in a direction of deflation) of the liquid chemical bag 50.

The joint 54 with the valve includes a joint part 55 and a valve 56 screwed with the joint part 55. Preferably, a known Luer-Lock type joint 57 is provided to an end part of the valve 56.

In case of omitting valve operation, an automatic open-close valve may be suitably employed instead of the valve 56. For example, a joint with a valve (not shown), in which the valve is capable of being connected to the joint part 55, capable of automatically opening by being connected to the joint part 55 and capable of automatically closing by being disconnected therefrom, may be suitably employed.

The joint part 55 is provided to the port part 53 and sealed by an O-ring 58.

Further, a liquid chemical suction pipe 61 is fixed to the joint 54 with the valve and extended to near a bottom part of the liquid chemical bag 50 so as to securely suck the liquid chemical even when a residual quantity of the liquid chemical is small (see FIG. 12A).

As described above, the liquid chemical bag 50 is suspended from the bag holding part 52.

As shown in FIG. 12B, the bag holding part 52 has a suspending tool 60, whose front end part is formed into a U-shape, and the port part 53 is inserted into the U-shaped part of the suspending tool 60, so that the liquid chemical bag 50 can be held in a suspended state. A flange part (an engage part) 53*a* is provided to an upper part of the port part 53, and the liquid chemical bag 50 is suspended and held, in a state where the joint 54 with the valve is on the upper side, by engaging the flange part 53*a* with the suspending tool 60.

By suspending the liquid chemical bag 50, even if a defect accidentally occurs in a connecting part of the joint 54 with the valve and the liquid chemical leaks, the leakage can be highly restrained.

The suspending tools 60 are held in an upper part of the bag holding part 52 by a holding section 62.

The holding section 62 is fixed to a slider 64 through a supporting rod 63 (see FIG. 11).

The slider 64 is capable of moving forward and backward along rails 66, which are fixed to a base 65. Therefore, the bag holding part 52 is capable of moving in the forth and back direction of the polishing apparatus 5 along the rails 66. When the slider 64 is forwardly drawn out from the polishing apparatus 5, the bag holding part 52 is exposed. Therefore, the vacant liquid chemical bags 50 can be easily exchanged.

Note that, as clearly shown in FIG. 10, the five suspending tools 60 are arranged in a zigzag form in a plan view. Therefore, the liquid chemical bags 50, which are filled with the liquid chemicals and in flat states, are suspended and held in the zigzag form, in which about ⅓ of the liquid chemical bag 50, in the width direction, overlaps the adjacent liquid chemical bag 50.

Since the flat liquid chemical bags 50 are held in the state where the adjacent liquid chemical bags 50 are shifted in the width direction from each other, a length and a width of the liquid chemical supplying section 7 can be downsized, so that the polishing apparatus 5 can be downsized on the basis of the minimal fab concept. The size of the processing chamber can comply with the standard, e.g., about 30 cm square. Further, a plurality of the liquid chemical bags 50 (e.g., five bags) can be used. By setting a plurality of the liquid chemical bags 50 which respectively store a plurality of kinds of liquid chemicals, so that utility of the work processing apparatus can be enhanced. Further, by using a plurality of the liquid chemical bags 50 which store the same liquid chemical, the liquid chemical bag can be easily exchanged and continuous operation of the apparatus can be easily performed.

As described above, in the work processing apparatus, a plurality of the liquid chemical bags 50 can be easily exchanged, so that usability of the apparatus can be improved. For example, if the liquid chemical bags 50 are respectively filled with a polishing liquid and pure water, a mixed liquid can be supplied (see claim 9).

As described above, the liquid chemical bag 50 is produced by laminating the two flexible resin sheets, whose edge parts are welded to form into the bag. The liquid chemical bag 50 is filled with a prescribed quantity of the liquid chemicals in a state where no air is included in the liquid chemical bag 50. Therefore, the liquid chemical is not in contact with air, so that oxidization of the liquid chemical can be prevented. Even if the liquid chemical is consumed and reduced, the liquid chemical bag 50 composed of the flexible resin sheets deflates without invasion of air, so that drying, condensing and solidifying the liquid chemical can be prevented.

In a conventional work processing apparatus, a hard resin tank is used to supply a liquid chemical (e.g., slurry). On the other hand, in the present invention, an idea of downsizing the hard resin tank is not employed. Thus, strength of the liquid chemical bag 50, chemical stability thereof to liquid chemicals, etc. are confirmed so as to employ the liquid chemical bag 50 which has not been used in the field of the present invention, so that the effect of preventing condensation and solidification can be obtained and a production cost of the apparatus can be reduced in the present invention.

Note that, it is difficult to discharge 100% of air from the liquid chemical bag 50 when filling the liquid chemical bag 50 with the liquid chemical. A function of air discharging means has limited, but a small quantity of air may remain in the liquid chemical bag 50. Namely, even if a small quantity of air remains, the liquid chemical can be used as far as a bad influence caused by contacting air is reduced to the level causing no problems in practical use.

As shown in FIG. 13, a through-hole 67, which communicates with an inside and an outside of a chemical path 55*a*, is formed in the joint part 55 of the joint 54 with the valve and located at a position under the O-ring 58 of the joint part 55. With this structure, the chemical path 55*a* communicates with an upper part of the liquid chemical bag 50 via the through-hole 67. When feeding the liquid chemical is started, a lower-layer liquid chemical in the liquid chemical bag 50 is sucked through the liquid chemical suction pipe 61, and an upper-layer liquid chemical therein, which includes air, is simultaneously sucked through the through-hole 67 and the chemical path 55*a*. As a result, air which has remained before feeding the liquid chemical can be discharged. Namely, the liquid chemical can be stored, in the liquid chemical bag 50, without contacting air by starting to feed the liquid chemical.

As shown in FIG. 9, in each of the liquid chemical bags 50, a tube 68 is connected to the Luer-Lock type joint 57, and the tube 68 is connected to a feeding pump 69. The liquid chemicals are fed from the liquid chemical bags 50 to the primary polishing plate 40 and the secondary polishing plate 41 of the polishing section 6, the cleaning part 44, the cleaning/drying unit 25, etc., by the feeding pump 69 so as to perform various processings.

A liquid chemical feeding part is constituted by the tube 68, the feeding pump 69, etc.

Note that, weights of the liquid chemical bags 50, which are suspended in the bag holding part 52, are measured by a measuring section (not shown). When the weight of the liquid chemical bag 50 reaches a predetermined weight or less, the control section 8 controls a warning section to send a warning signal for urging to exchange the liquid chemical bag 50.

The liquid chemical used in the polishing section 6 is collected and stored in a drainage tank 59.

As described above, the liquid chemical bag 50 is filled with the liquid chemical without including air.

Figure 14:
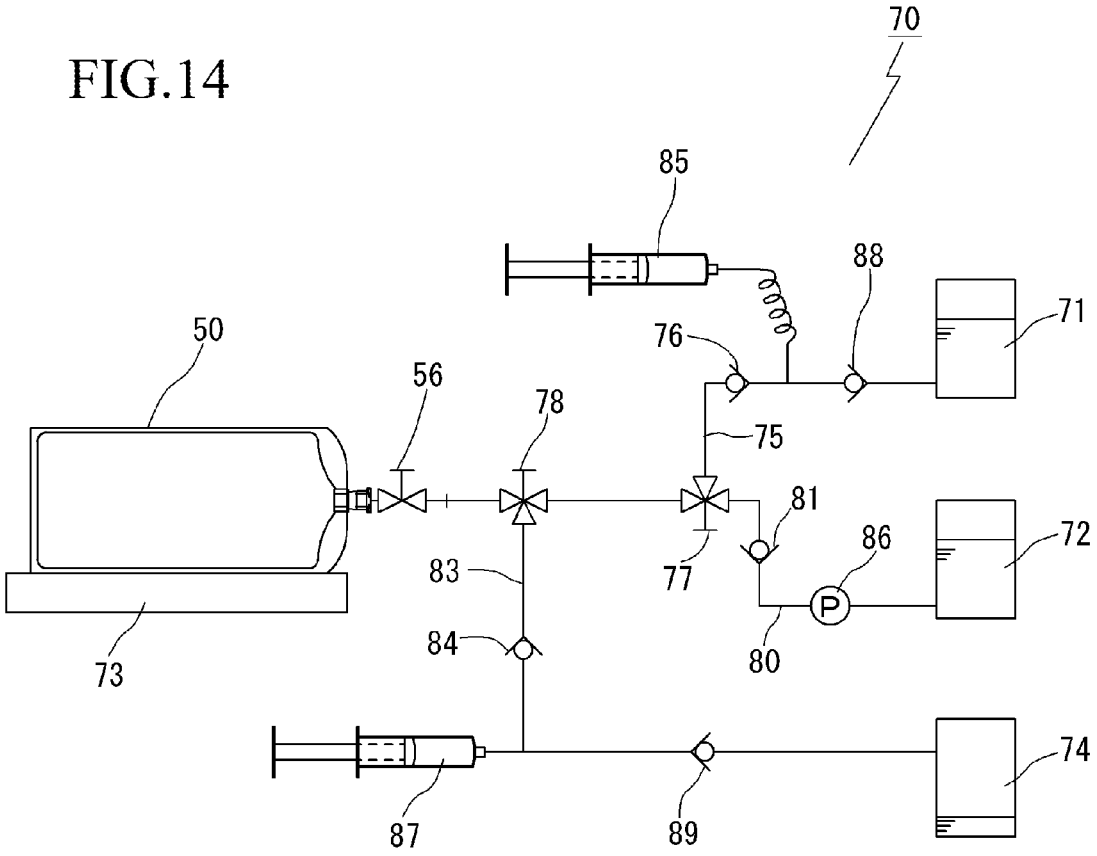
FIG. 14 is a circuit diagram of a filling device.

Preferably, the liquid chemical is fed into the liquid chemical bag 50 by a filling device 70 shown in FIG. 14.

The filling device 70 will be explained. Note that, in the present embodiment, the filling device 70 is provided to the inside or outside of the polishing apparatus 5. Further, the filling device 70 can be regarded as an independent invention separated from the work processing apparatus (the polishing apparatus 5).

A raw liquid storing part 71 stores a raw liquid of a liquid chemical. A pure water storing part 72 stores pure water. The liquid chemical bag 50 is mounted on a mounting part 73. Preferably, a measuring part (not shown) for measuring a weight of the liquid chemical bag 50 is provided to the mounting part 73.

A symbol 74 stands for a discharge tank.

a first pipeline 75 is communicated with the liquid chemical bag 50, from the raw liquid storing part 71, via a first check valve 76, a first three-way valve 77, a second three-way valve 78 and the valve 56 in this order, so that the first pipeline 75 is capable of supplying the liquid chemical from the raw liquid storing part 71 to the liquid chemical bag 50.

A second pipeline 80 is communicated with the liquid chemical bag 50, from the pure water storing part 72, via a second check valve 81, the first three-way valve 77, the second three-way valve 78 and the valve 56 in this order, so that the second pipeline 80 is capable of supplying the pure water from the pure water storing part 72 to the liquid chemical bag 50.

A third pipeline 83 is communicated with the discharge tank 74, from the liquid chemical bag 50, via the valve 56, the second three-way valve 78 and a third check valve 84 in this order, so that the third pipeline 83 is capable of discharging air from the liquid chemical bag 50 to the discharge tank 74.

A first pump 85 is provided to the first pipeline 75 between the first check valve 76 and the raw liquid storing part 71, and the first pump 85 feeds the liquid chemical from the raw liquid storing part 71 to the liquid chemical bag 50 via the first pipeline 75.

A second pump 86 is provided to the second pipeline 80 between the second check valve 81 and the pure water storing part 72, and the second pump 86 feeds the pure water from the pure water storing part 72 to the liquid chemical bag 50 via the second pipeline 80.

A third pump 87 is provided to the third pipeline 83 between the third check valve 84 and the discharge tank 74, and the third pump 87 discharges air from the liquid chemical bag 50 to the discharge tank 74 via the third pipeline 83.

Note that, in the present embodiment, a syringe is used as the first pump 85. In this case, a fourth check valve 88 should be provided to the first pipeline 75 between the syringe 85 and the raw liquid storing part 71. Further, in the present embodiment, a syringe is used as the third pump 87. In this case, a fifth check valve 89 should be provided to the third pipeline 83 between the syringe 87 and the discharge tank 74.

In the present embodiment, the filling device 70 can fill the liquid chemical bag 50 with the liquid chemical which has been produced by diluting the raw liquid with pure water.

Steps of filling the liquid chemical bag 50 with the liquid chemical by the filling device 70 will be explained.

<Step of Removing Air>

The syringe 87 is actuated to suck air from the liquid chemical bag 50 and discharge the air to the discharge tank 74 via the third pipeline 83, so that air can be removed from the liquid chemical bag 50.

<Step of Feeding Liquid Chemical to Pipelines>

The syringe 85 is actuated to fill the first pipeline 75, until the second three-way valve 78, with the liquid chemical (raw liquid) stored in the raw liquid storing part 71 and to fill the third pipeline 83, from the second three-way valve 78 toward the discharge tank 74, with the liquid chemical (raw liquid) stored in the raw liquid storing part 71.

<Step of Measuring Liquid Chemical>

Next, the second three-way valve 78 is switched and the syringe 85 is actuated to feed the liquid chemical into the liquid chemical bag 50 with measuring the liquid chemical in the raw liquid storing part 71. In this case, the pipeline between the second three-way valve 78 and the liquid chemical bag 50, which was initially vacant, is filled with the liquid chemical and the liquid chemical remains there, so the liquid chemical is insufficiently fed into the liquid chemical bag 50 and the shortage corresponds to the capacity of the pipeline.

<Step of Pure Water Replacement in Pipelines>

Next, the first three-way valve 77 and the second three-way valve 78 are switched and the second pump 86 is actuated to feed the pure water into the second pipeline 80 until the second three-way valve 78 and the third pipeline 83 from the second three-way valve 78 toward the discharge tank 74.

<Step of Filling Pure Water>

Next, the second three-way valve 78 is switched and the second pump 86 is actuated to feed the pure water into the liquid chemical bag 50 through the second pipeline 80. In this step, the insufficient liquid chemical remaining in the pipeline between the second three-way valve 78 and the liquid chemical bag 50 is pushed out and fed into the liquid chemical bag 50, so that the prescribed quantity of the liquid chemical measured by the syringe 85 is fed into the liquid chemical bag 50. A prescribed quantity of the pure water is supplied to the liquid chemical bag 50 by measuring the weight of the liquid chemical bag 50 by the measuring part provided to the mounting part.

As described above, the liquid chemical diluted to a predetermined concentration is fed to the liquid chemical bag 50.

In the above described steps, it goes without saying that the first three-way valve 77 and the second three-way valve 78 are set in required directions.

In the above described embodiment, the quantity of the liquid chemical is measured by the syringe 85, but the liquid chemical may be fed by measuring the weight thereof and actuating an ordinary pump.

After the valve 56 is closed, the liquid chemical bag 50 is detached from the filling device 70 and then attached to the bag holding part 52 of the polishing apparatus 5, so that the liquid chemical bag 50 can be used for the polishing operation.

Note that, in the above described embodiment, the raw liquid is diluted, but the raw liquid may be fed into the liquid chemical bag 50. In this case, the raw liquid may be diluted, with the pure water, in the halfway stage of feeding the liquid chemical to the polishing section 6 of the polishing apparatus 5. In case of filling the liquid chemical bag 50 with the raw liquid too, the filling device 70 can be used.

The structure and function for removing air when the liquid chemical is fed into the liquid chemical bag 50 by the filling device 70 can be applied to a case that the liquid chemical bag 50 is attached to the polishing apparatus 5. For example, even if moisture is evaporated or air invades into the liquid chemical bag 50, after attaching the liquid chemical bag 50 to the polishing apparatus 5, by aging effect, the polishing operation, etc., air can be rapidly discharged to the outside of the liquid chemical bag 50 via the through-hole 67 because the through-hole 67 is formed in the upper end part of the liquid chemical bag 50.

Figure 15:
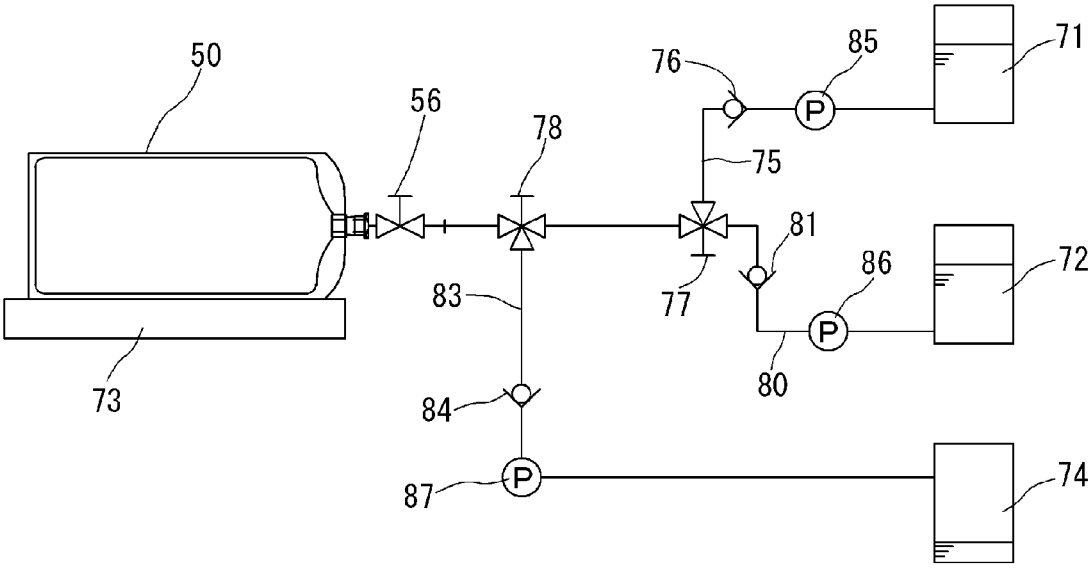
FIG. 15 is a circuit diagram of another filling device.

FIG. 15 is a circuit diagram of another example of the filling device 70.

The structural elements shown in FIG. 14 are assigned the same numeric symbols.

In the present example, a first liquid chemical and a second liquid chemical can be mixed and fed into the liquid chemical bag 50. Namely, the first liquid chemical is stored in the raw liquid storing part 71, and the second liquid chemical is stored in the pure water storing part 72.

An operation manner is the same as that of the filling device 70 shown in FIG. 14, so explanation will be omitted. In the filling device shown in FIG. 15, the both liquids to be fed are liquid chemicals (except pure water), so the quantity of the liquid chemicals to be fed is increased. Therefore, the measuring operation by the syringe is not performed, but the quantity is calculated on the basis of the measured weights. Thus, the feeding pump 85 is employed instead of the syringe.

In the above described embodiment, the semiconductor wafer polishing apparatus 5 has been explained as the work processing apparatus of the present invention. The present invention in not limited to the above described embodiment, so it may be applied to, for example, a semiconductor device producing apparatus, e.g., CVD apparatus, and a grinding apparatus in which liquid chemicals, e.g., machining oil, are used.

In the above described embodiment, the liquid chemical is fed into the liquid chemical bag 50, by the filling device 70, without air-invasion, and air remaining in the liquid chemical bag 50 can be removed by attaching the liquid chemical bag 50, which has been filled with the liquid chemical, to the work polishing apparatus 5 and starting to feed the liquid chemical, so that the system in which no liquid chemical is dried, condensed and solidified can be realized.

In the conventional work processing apparatus for small lot production of a wide variety of products, it is difficult to exchange and store liquid chemicals. On the other hand, the system of the present invention is capable of easily exchange liquid chemicals and store the same for a long time.

The minimal fab concept proposes a very small production system without huge investment. Further, the minimal fab concept is capable of not only performing small lot production of a wide variety of products but also performing multi-variety variable production (or variety and variable production). By realizing the minimal fab concept, wastes of production can be saved and a production cost can be reduced, so that international competitiveness can be obtained and worsening of the earth environment can be prevented.

The present invention is an important technology of the minimal fab concept, which is expected by semiconductor industries, and the technology can contribute to realize the minimal fab concept.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alternations could be made hereto without departing from the spirit and scope of the invention.

What is claimed is:

1. A work processing apparatus, comprising:

a processing section for processing or treating a work; and a liquid chemical supplying section for supplying a liquid chemical to the processing section, wherein the liquid chemical supplying section includes: a plurality of liquid chemical bags for storing the liquid chemical; a bag holding part in which the liquid chemical bags are attached and held; and a liquid feeding part, to which the liquid chemical bags are detachably connected, for feeding the liquid chemical from the liquid chemical bags to the processing section, each of the liquid chemical bags is produced by overlapping flexible resin sheets with each other and welding their edge parts to form into a bag, and has a port part communicating with an outside, and a joint with a valve is attached to each of the port parts, wherein the bag holding part is located under the processing section and capable of being drawn out forward.

2. The work processing apparatus according to claim 1, wherein the liquid chemical bags are filled with the liquid chemical in a state where air has been removed therefrom.

3. The work processing apparatus according to claim 1, wherein each of the liquid chemical bags is suspended and held in the bag holding part in a state where the joint with the valve is on the upper side, and a liquid chemical suction pipe is provided in each of the liquid chemical bags and extended downward.

4. The work processing apparatus according to claim 3, wherein the liquid chemical bags are suspended and formed in a flat shape in a state where the adjacent liquid chemical bags are alternately shifted, in a width direction, from each other.

5. The work processing apparatus according to claim 1, further comprising a measuring section for measuring weights of the liquid chemical bags held in the bag holding part.

6. The work processing apparatus according to claim 1, wherein the joint with the valve is a Luer-Lock type joint.

7. The work processing apparatus according to claim 1, wherein the liquid chemical bags include the bag filled with a polishing liquid.

8. The work processing apparatus according to claim 1, wherein the liquid chemical bags separately include the bag filled with a polishing liquid and the bag filled with pure water.

9. The work processing apparatus according to claim 1, wherein the liquid chemical bags include the bag filled with a rinsing liquid for rinsing the work.

10. The work processing apparatus according to claim 1, wherein the liquid chemical bags include the bag filled with a cleaning liquid for cleaning the work.

11. The work processing apparatus according to claim 1, wherein the work is a semiconductor wafer of ½ inch size.

12. A work processing apparatus, comprising:

a processing section for processing or treating a work;

a liquid chemical supplying section for supplying a liquid chemical to the processing section, wherein the liquid chemical supplying section includes:

a plurality of liquid chemical bags for storing the liquid chemical; a bag holding part in which the liquid chemical bags are attached and held; and a liquid feeding part, to which the liquid chemical bags are detachably connected, for feeding the liquid chemical from the liquid chemical bags to the processing section;

each of the liquid chemical bags is produced by overlapping flexible resin sheets with each other and welding their edge parts to form into a bag, and has a port part communicating with an outside; and a joint with a valve is attached to each of the port parts; and a filling device for filling the liquid chemical bags with the liquid chemical or chemicals, wherein the filling device includes: an air discharging part for discharging air from the liquid chemical bags; and a measuring part for measuring a weight or a capacity of the liquid chemical filling each of the liquid chemical bags.

13. The work processing apparatus according to claim 12, wherein the filling device further includes:

a raw liquid storing part for storing a raw liquid of the liquid chemical;

a pure water storing part for storing pure water;

a mounting part on which the liquid chemical bag is mounted;

a discharge tank;

a first pipeline being communicated with the liquid chemical bags, from the raw liquid storing part, via a first check valve, a first three-way valve and a second three-way valve in this order, the first pipeline being capable of supplying the liquid chemical from the raw liquid storing part to the liquid chemical bags;

a second pipeline being communicated with the liquid chemical bags, from the pure water storing part, via a second check valve, the first three-way valve and the second three-way valve in this order, the second pipeline being capable of supplying the pure water from the pure water storing part to the liquid chemical bags;

a third pipeline being communicated with the discharge tank, from the liquid chemical bags, via the second three-way valve and a third check valve in this order, the third pipeline being capable of discharging air from the liquid chemical bags to the discharge tank;

a first pump being provided to the first pipeline between the first check valve and the raw liquid storing part, the first pump feeding the liquid chemical from the raw liquid storing part to the liquid chemical bags via the first pipeline;

a second pump being provided to the second pipeline between the second check valve and the pure water storing part, the second pump feeding the pure water from the pure water storing part to the liquid chemical bags via the second pipeline; and a third pump being provided to the third pipeline between the third check valve and the discharge tank, the third pump discharging air from the liquid chemical bags to the discharge tank via the third pipeline.

14. The work processing apparatus according to claim 13, wherein the first pump is a syringe, a fourth check valve is provided to the first pipeline between the syringe and the raw liquid storing part, the third pump is a syringe, and a fifth check valve is provided to the third pipeline between the syringe and the discharge tank.

15. The work processing apparatus according to claim 12, wherein the filling device includes:

a first liquid chemical storing part for storing a first liquid chemical;

a second liquid chemical storing part for storing a second liquid chemical;

a mounting part on which the liquid chemical bag is mounted;

a discharge tank;

a first pipeline being communicated with the liquid chemical bags, from the first liquid chemical storing part, via a first check valve, a first three-way valve and a second three-way valve in this order, the first pipeline being capable of supplying the first liquid chemical from the first liquid chemical storing part to the liquid chemical bags;

a second pipeline being communicated with the liquid chemical bags, from the second liquid chemical storing part, via a second check valve, the first three-way valve and the second three-way valve in this order, the second pipeline being capable of supplying the second liquid chemical from the second liquid chemical storing part to the liquid chemical bags;

a third pipeline being communicated with the discharge tank, from the liquid chemical bags, via the second three-way valve and a third check valve in this order, the third pipeline being capable of discharging air from the liquid chemical bags to the discharge tank;

a first pump being provided to the first pipeline between the first check valve and the first liquid chemical storing part, the first pump feeding the first liquid chemical from the first liquid chemical storing part to the liquid chemical bags via the first pipeline;

a second pump being provided to the second pipeline between the second check valve and the second liquid chemical storing part, the second pump feeding the second liquid chemical from the second liquid chemical storing part to the liquid chemical bags via the second pipeline; and a third pump being provided to the third pipeline between the third check valve and the discharge tank, the third pump discharging air from the liquid chemical bags to the discharge tank via the third pipeline.

* * * * *